US006240905B1

(12) United States Patent
Boecking

(10) Patent No.: US 6,240,905 B1
(45) Date of Patent: Jun. 5, 2001

(54) UNIT FUEL INJECTOR

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/365,180

(22) Filed: Aug. 2, 1999

(30) Foreign Application Priority Data

Aug. 6, 1998 (DE) ..... 198 35 494

(51) Int. Cl.[7] ..... F02M 37/04; F02M 47/02
(52) U.S. Cl. ..... 123/498; 239/91; 239/93
(58) Field of Search ..... 123/498, 446, 123/501; 239/91, 93, 124, 88, 89, 90, 92, 94, 95, 125, 584, 585.1, 585.5; 310/320, 328

(56) References Cited

U.S. PATENT DOCUMENTS 4,101,076 * 7/1978 Bart ..... 239/584
4,662,338 * 5/1987 Itoh et al. ..... 123/467
4,813,601 * 3/1989 Schwerdt et al. ..... 239/91
4,917,068 * 4/1990 Takahashi et al. ..... 123/506

FOREIGN PATENT DOCUMENTS 37 28 817 C2 3/1992 (DE) .
1 95 19 192 C1 6/1996 (DE) .

* cited by examiner

*Primary Examiner*—Henry C. Yuen
*Assistant Examiner*—Mahmoud M Gimie
(74) *Attorney, Agent, or Firm*—Ronald E. Greigg; Edwin E. Greigg

(57) ABSTRACT

A unit fuel injector for delivering fuel to a combustion chamber of direct-injection internal combustion engines, having a pump unit for building up an injection pressure and for injecting the fuel via an injection nozzle into the combustion chamber. A control unit with a control valve that is embodied as an outward-opening A-valve, and a valve actuation unit for controlling the pressure buildup in the pump unit. In order to create a unit fuel injector with a control unit that has a simple design, is small in size, and in particular has a short response time, the valve actuation unit is embodied as a piezoelectric actuator.

3 Claims, 3 Drawing Sheets

UNIT FUEL INJECTOR

FIELD OF THE INVENTION

The present invention relates to a unit fuel injector for delivering fuel to a combustion chamber of direct-injection internal combustion engines, having a pump unit for building up an injection pressure and for injecting the fuel via an injection nozzle into the combustion chamber. The invention further includes a control unit with a control valve that is embodied as an outward-opening A-valve, and a valve actuation unit for controlling the pressure buildup in the pump unit.

BACKGROUND OF THE INVENTION

In an injection system of this kind, the pump unit and the injection nozzle form a unit. One unit fuel injector (UFI) per engine cylinder is incorporated into the cylinder head and driven by an engine cam shaft either directly via a tappet or indirectly via tilt levers.

In the unit fuel injectors known from the prior art, the control units are as a rule embodied as magnet valves. The valve actuation unit is embodied as an electromagnet that actuates the control valve. The magnet valve is open in the unexcited state. This provides a free flow from the pump unit to the low-pressure region of the system and thus enables filling of the pump chamber during the intake stroke of the pump piston as well as a return flow of fuel during the pumping stroke. Triggering the magnet valve during the pumping stroke of the pump piston closes this bypass. This leads to a pressure buildup in the high-pressure region and, after the opening pressure of the injection nozzle is exceeded, to the injection of fuel to the combustion chamber of the engine. The closing time of the magnet valve thus determines the onset of injection, and the closing duration of the magnet valve determines the injection quantity.

The UFI is a time-controlled injection system; that is, a mechanical connection between the onset of injection and the cam shaft position is lacking. The injection onset must therefore be associated as precisely as possible with a certain engine piston position or crank shaft position. To that end, an engine control unit is supplied with information on the engine piston position or crank shaft position. The electromagnet of the magnet valve is triggered for controlling the injection events in accordance with the chronological order stored in memory in the engine control unit and in accordance with the information obtained.

The known UFIs with control units embodied as magnet valves have the disadvantage, however, that typically magnet valves have a very long response time. The reason is that the magnet armature of a magnet valve, because of its mass, cannot be accelerated arbitrarily fast, since mass inertia forces are acting on it. In addition, the magnetic field must first be built up to generate the attraction force. Magnet valves are moreover relatively large in size and have a relatively large number of individual parts which must be assembled into the magnet valves in production. This is time-consuming and labor-intensive and makes the magnet valves quite expensive.

OBJECT AND SUMMARY OF THE INVENTION

In view of the above disadvantages of the prior art, it becomes an object of the present invention to create a unit fuel injector with a control unit that is simple in structure, small in size, and in particular has a short response time.

To attain this object, the invention, taking the unit fuel injector of the type defined at the outset as the point of departure, proposes that the valve actuation unit be embodied as a piezoelectric actuator.

So-called A-valves close outward, counter to the flow direction. In contrast to this, so-called I-valves close inward, in the flow direction.

The piezoelectric actuator comprises a crystal, for instance of barium titanate ($BaTiO_3$) or lead titanate ($PbTiO_3$) which can be polarized by compressive or tensile strain. The polarization creates surface charges of different signs on opposed surfaces (this is known as the piezoelectric effect).

In the piezoelectric actuator, the so-called reciprocal piezoelectric effect is utilized. In crystals of the above type, by applying an electrical field, a change in length can be brought about as a function of the polarity and direction of the field.

This change in length is utilized to actuate the control valve.

Since a piezoelectric actuator has no moving parts and instead the change in length is based slowly on a shift in the crystal lattice structure, it has especially short response times. Furthermore, piezoelectric actuators are not subject to any wear and are economical to make. Piezoelectric actuators are thus especially well suited for actuating the control valve of a unit fuel injector.

In an advantageous refinement of the invention, the control unit has means for deflecting the expansion motion of the piezoelectric actuator into a differently oriented valve actuation motion. This has the advantage that the piezoelectric actuator can be positioned virtually arbitrarily with respect to the control valve triggered by it. This advantageously leads to greater freedom in designing the control units of the invention.

In another advantageous refinement of the unit fuel injector of the invention, it is proposed that the control unit has means for stepping up the expansion motion of the piezoelectric actuator to a greater valve actuation motion. This has the advantage that in the UFI of the invention, especially small-sized piezoelectric actuators can be used. The maximum change in length of a piezoelectric actuator is dependent on its external dimensions. Small piezoelectric actuators accordingly have a lesser change in length than larger actuators. To enable certain, reliable actuation of the control valve despite the lesser expansion motion of a small-size piezoelectric actuator, the means for stepping up the expansion motion to a greater valve actuation motion are employed. Stepping up the expansion motion of the piezoelectric actuator necessarily leads to a reduction in the force of the stepped-up valve actuation motion. The outer dimensions of the piezoelectric actuator and the step-up ratio must therefore be selected such that on the one hand the length and on the other the force of the valve actuation motion are sufficient to actuate the control valve in a certain and reliable way.

In still another refinement of the invention, it is proposed that the control unit has means that act as a thermal compensation element between the piezoelectric actuator and the control valve. The expansion coefficient of the piezoelectric actuator, which is typically a crystal, differs from that of the control valve, which is typically of metal. Because of the different temperature coefficients, in a control unit with a piezoelectric actuator rigidly joined to the control valve, temperature fluctuations can cause unintended actuation of the control valve. To compensate for the effects of the different temperature coefficients and to prevent unintended actuation of the control valve, a compensation element is provided between the piezoelectric actuator and the control valve.

Advantageously, the means for deflecting and/or the means for stepping up the expansion motion of the piezoelectric actuator and/or the means for compensating for the effects of the different temperature coefficients of the piezoelectric actuator and control valve are embodied as a hydraulic step-up arrangement. A hydraulic step-up arrangement on the one hand represents a sufficiently rigid connection between the piezoelectric actuator and the control valve. On the other, by the hydraulic step-up arrangement, the expansion motion of the piezoelectric actuator can be deflected into a differently oriented valve actuation motion. Furthermore, the expansion motion of the piezoelectric actuator can thereby be stepped up to a greater valve actuation motion. Finally, the hydraulic step-up arrangement also acts as a thermal compensation element between the piezoelectric actuator and the control valve.

The present invention also relates to a control unit with a control valve that is embodied as an outward-opening A-valve, and having a valve actuation unit for controlling the pressure buildup in a pump assembly.

To create a control unit of simple construction and small size and that in particular has a short response time, the invention, taking the aforementioned control unit as the point of departure, proposes that the valve actuation unit be formed as a piezoelectric actuator.

In an advantageous refinement of the invention, the pump assembly is embodied as a pump unit of a unit fuel injector for delivering fuel to a combustion chamber of direct-injection internal combustion engines, which injector builds up an injection pressure and injects the fuel into the combustion chamber of the engine via an injection nozzle.

Particularly in this kind of use, the advantages of the control unit of the invention become especially influential.

Advantageously, the control unit has means for deflecting the expansion motion of the piezoelectric actuator into a differently oriented valve actuation motion. The direction of the valve actuation motion is preferably counter to the direction of the expansion motion of the piezoelectric actuator.

Advantageously, the control unit has means for stepping up the expansion motion of the piezoelectric actuator to a greater valve actuation motion. The control unit also preferably has means that act as a thermal compensation element between the piezoelectric actuator and the control valve.

In an advantageous refinement of the control unit of the invention, the means are embodied as a hydraulic step-up arrangement.

The hydraulic step-up arrangement advantageously has a hydraulic reservoir, which is filled with a hydraulic fluid and with which the piezoelectric actuator and a valve body of the control valve communicate hydraulically in sealed fashion; the expansion motion of the piezoelectric actuator raises the pressure in the hydraulic reservoir, and the pressure change in the hydraulic reservoir displaces the valve body axially.

Advantageously, a spring element forces a valve plate, extending on the outside around the valve body, into an open position away from a valve seat of the control valve, and a pressure increase in the hydraulic reservoir forces the valve plate onto the valve seat in a closing position, counter to the force of the spring element.

In an advantageous refinement of the invention, the piezoelectric actuator and the control valve are disposed such that their respective longitudinal axis extend at a distance from and parallel to one another.

Alternatively, the piezoelectric actuator and the control valve are disposed such that their respective longitudinal axis coincide.

The present invention finally also relates to a method for controlling the pressure buildup in a pump unit by means of a control unit having a control valve embodied as an outward-opening A-valve, and having a valve actuation unit, the pump unit being a component of a unit fuel injector for delivering fuel to a combustion chamber of direct-injection internal combustion engines, and the pump unit builds up an injection pressure and injects the fuel into the combustion chamber via an injection nozzle.

To create a method for controlling the pressure buildup in a pump unit of a unit fuel injector that operates with simple, reliable means and in particular has a short response time, the invention based on the above method proposes that the valve actuation unit is embodied as a piezoelectric actuator and the control valve is triggered by the piezoelectric actuator.

To deflect the expansion motion of the piezoelectric actuator to a differently oriented valve actuation motion, step up the expansion motion of the piezoelectric actuator to a greater valve actuation motion, or compensate for the effects of the different temperature coefficients of the piezoelectric actuator and the control valve, it is proposed in an advantageous refinement of the invention that the expansion motion of the piezoelectric actuator is transmitted to the control valve via a hydraulic step-up arrangement.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
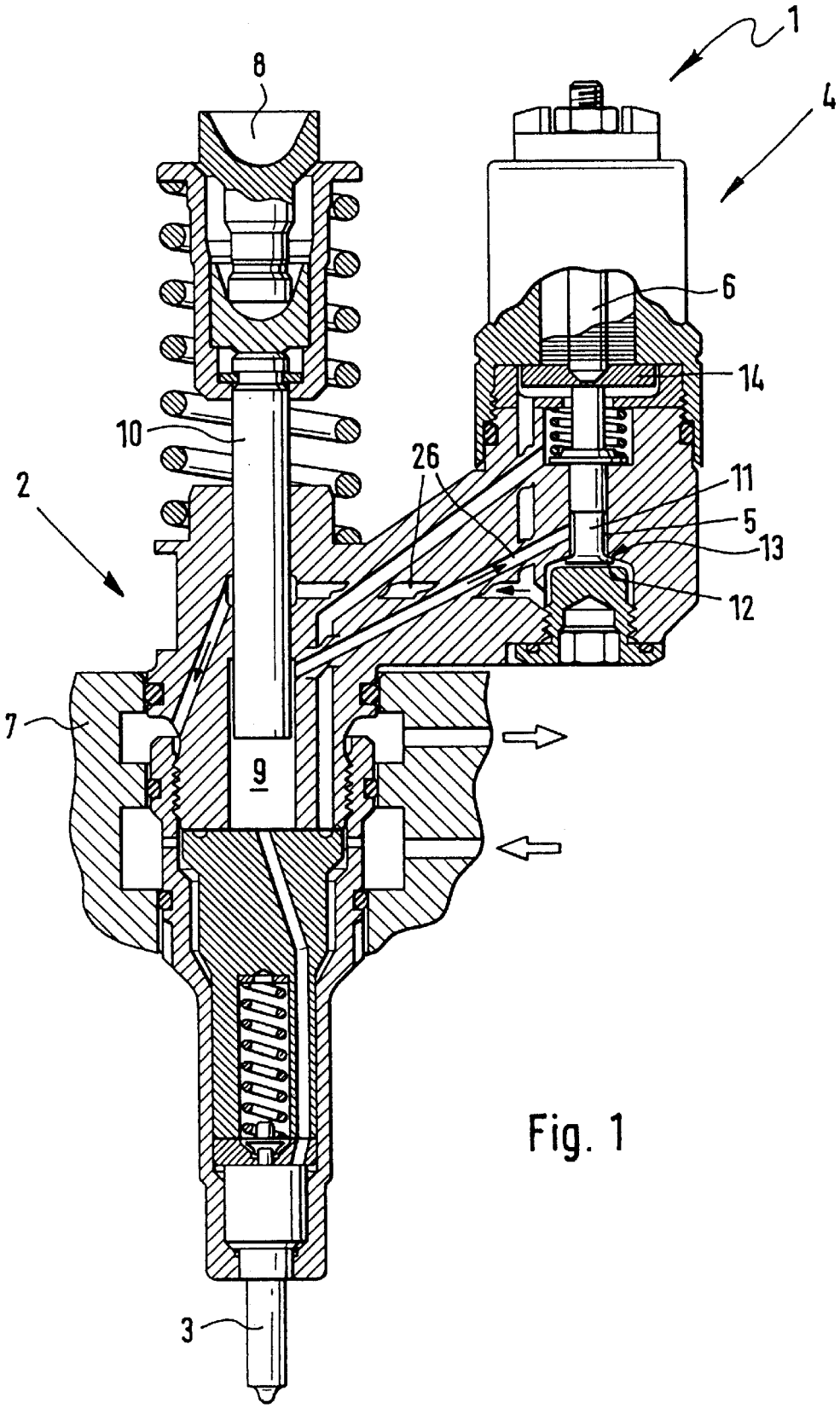
FIG. 1 shows a unit fuel injector of the invention.

In FIG. 1, the unit fuel injector is identified overall by reference numeral 1. The unit fuel injector 1 is used to deliver fuel to a combustion chamber of direct-injection internal combustion engines. The unit fuel injector 1 has a pump unit 2 for building up an injection pressure and for injecting the fuel into the combustion chamber via an injection nozzle 3. The unit fuel injector 1 also has a control unit 4, with a control valve 5 and a schematically shown valve actuation unit 6 for controlling the pressure buildup in the pump unit 2. In the unit fuel injector (UFI) 1, the pump unit 2 and the injection nozzle 3 form a unit. One UFI 1 per engine cylinder is built into the cylinder head of an internal combustion engine and driven either directly via a tappet or indirectly via tilt levers by an engine cam shaft (not shown) via an actuator 8.

A pump chamber 9 of the pump unit 2 communicates with the control valve 5 of the control unit 4 via bypass bores 26. In the non-excited state of the electric control unit 4, the control valve 5 is open. As a result, there is a free flow from the pump unit 2 to the low-pressure region of the system, and thus filling of the pump chamber 9 during the intake stroke of a pump piston 10 that is axially movable into the pump chamber 9 and a return flow of the fuel during the pumping stroke are possible (see the arrows in the bypass bores 26).

Triggering of the control unit 4 during the pumping stroke of the pump piston 10 closes this bypass. This leads to a pressure buildup in the high-pressure region, and once the opening pressure of the injection nozzle 3 is exceeded, it leads to the injection of fuel into the combustion chamber of the engine. The closing instant of the control unit 4 thus determines the injection onset, and the closing duration of the control unit 4 determines the injection quantity.

In the UFI 1 shown, the control valve 5 of the control unit 4 is embodied as an outward-opening A-valve, which has a valve body 11 that acts on a valve seat 13 counter to the flow direction and closes the control valve 5. The valve actuation unit 6 is embodied as a piezoelectric actuator. The valve actuation unit 6 and the control valve 5 communicate with one another via a hydraulic step-up arrangement 14. In FIG. 1, the hydraulic step-up arrangement 14 is shown only schematically. It will be described in further detail in FIGS. 2 and 3 in terms of two exemplary embodiments.

The hydraulic step-up arrangement 14 has a number of different tasks. First, it forms a rigid connection between the valve actuation unit 6 and the control valve 5, and it thus assures certain, reliable transmission of the expansion motion of the piezoelectric actuator to the A-valve. Furthermore, the expansion motion of the valve actuation unit 6 is deflected by the hydraulic step-up arrangement 14 into a differently oriented valve actuation motion. In the exemplary embodiment of FIG. 2, the downward-oriented expansion motion of the piezoelectric actuator is deflected into an upward-oriented valve actuation motion, or in other words one oriented in the opposite direction. By means of a suitable choice of the surface areas of the valve actuation unit 6 on the one hand and of the control valve 5 on the other that cooperate with the hydraulic step-up arrangement, a desired step-up ratio between the expansion motion of the piezoelectric actuator and the valve actuation motion can be attained. Relatively slight expansion motions of the piezoelectric actuator can thus be stepped up to relatively great valve actuation motions. Finally, the hydraulic step-up arrangement 14 also acts as a thermal compensation element between the valve actuation unit 6 and the control valve 5. In this function, the hydraulic step-up arrangement 14 compensates for the effects of the different temperature coefficients of the piezoelectric actuator, on the one hand, which typically comprises a ceramic crystal, and of the A-valve on the other, which typically comprises metal.

A guide ring 17 is disposed around a valve shaft 24 that is disposed above the valve body 11, and the guide ring is braced there against the valve body 11 by means of a disk 18 and a cup spring 19. The guide ring 17 rests with a flat seat 25 on the valve body 11. The flat seat 25 can also be embodied by other forms of seats. The guide ring 17 is supported axially displaceably in a bore 20.

The surface area of the valve actuation unit 6 cooperating with the hydraulic step-up arrangement 14 is $\pi/4\ D_3^2$. The effective area of the control valve 5 is $\pi/4\ (d_2^2-d_1^2)$. For the step-up ratio of the hydraulic step-up arrangement 14, the result is accordingly $(d_2^2-d_1^2)/D_3^2$.

Figure 2:
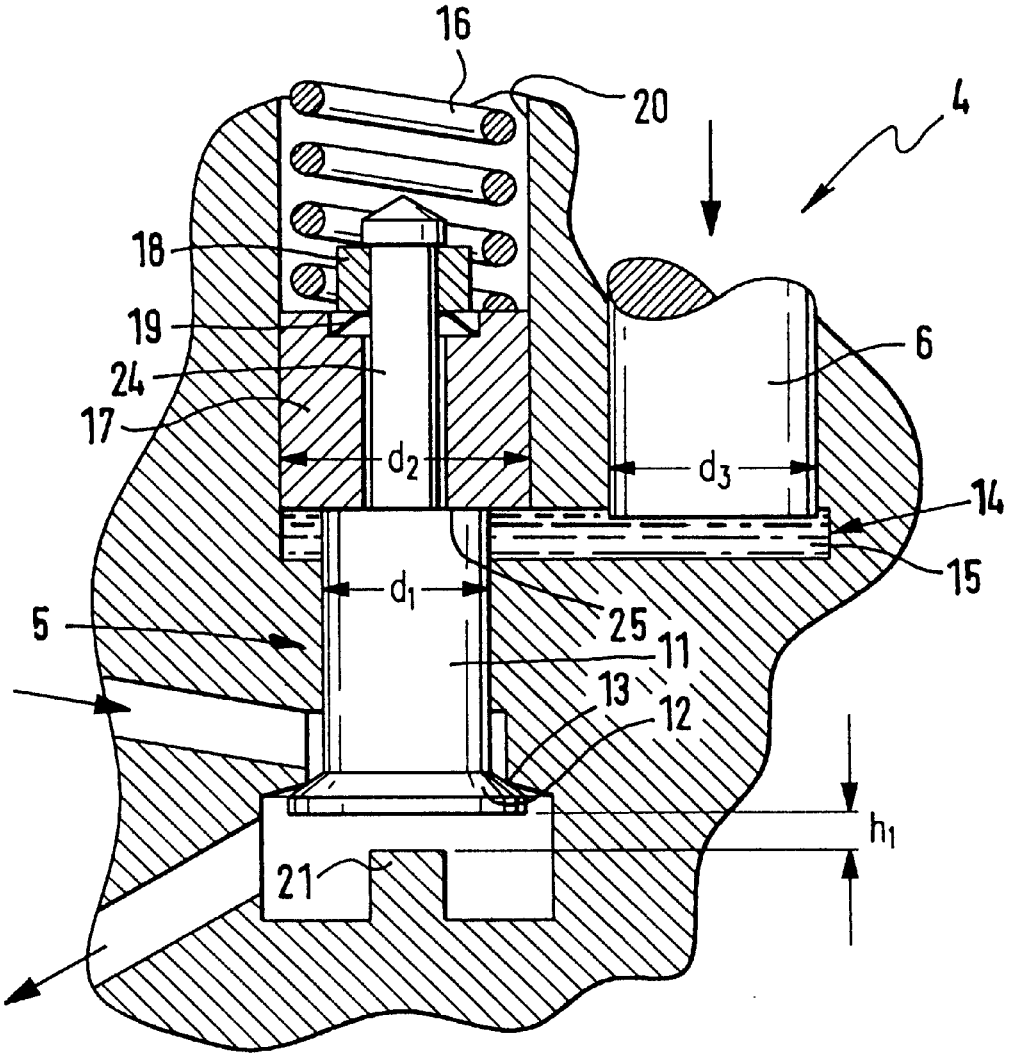
FIG. 2 shows a control unit of the invention in a first embodiment, in the form of a detail.

In the exemplary embodiment of FIG. 2, the valve actuation unit 6 and the control valve 5 are disposed such that their respective longitudinal axis extend at a distance from and parallel to one another.

The hydraulic step-up arrangement 14 has a reservoir 15 filled with a hydraulic fluid. The valve actuation unit 6 and the valve body 11 of the control valve 5 protrude, hydraulically sealed off, into the hydraulic reservoir 15. The expansion motion of the piezoelectric actuator takes place into the hydraulic reservoir 15 and leads to a pressure rise in the hydraulic reservoir 15. The valve body 11 protrudes into the hydraulic reservoir 15 in such a way that the pressure change in the hydraulic reservoir 15 leads to a displacement of the valve body 11 in the axial direction.

A spring element 16 forces a valve plate 12, extending on the outside of and around the valve body 11, away from the valve seat 13 of the control valve 5, in a non-excited state of the control unit 4, to an open position and causes it to meet a stop 21. As a result of a pressure rise in the hydraulic reservoir 15, the valve body 11 is displaced by the stroke $h_1$, and the valve plate 12 is forced counter to the force of the spring element 16 onto the valve seat 13 in a closing position.

Figure 3:
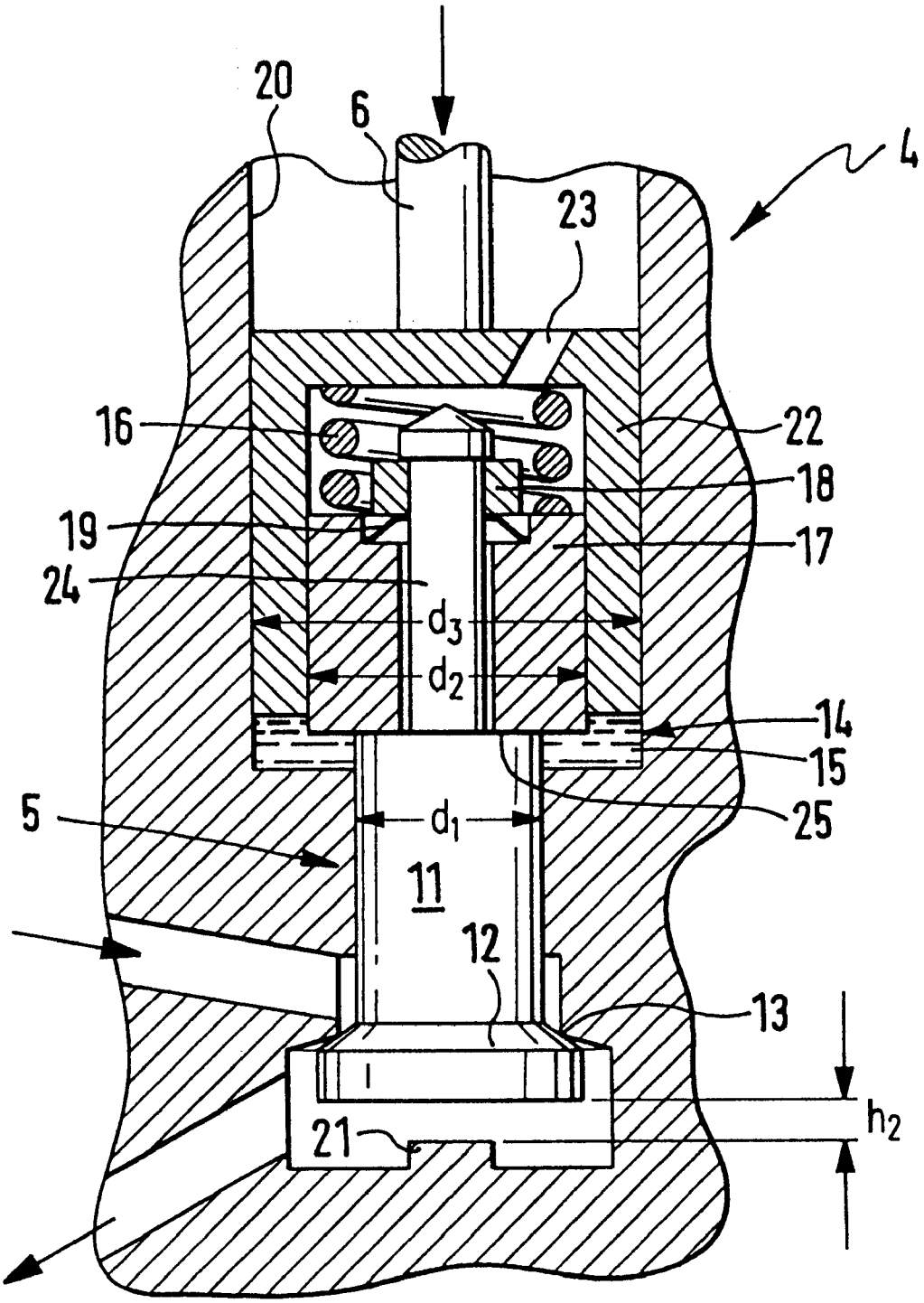
FIG. 3 shows a control unit of the invention in a second embodiment, again in the form of a detail.

In FIG. 3, the same reference numerals are used for like components. In the exemplary embodiment of FIG. 3, the valve actuation unit 6 is again embodied as a piezoelectric actuator. The expansion motion of the piezoelectric actuator is transmitted to a hollow-cylindrical transmission body 22, which is perpendicular to the hydraulic reservoir 15 and on its underside has a circular-annular area $\lambda/4\ (D_3^2-d_2^2)$ which acts on the hydraulic reservoir 15. On its top, the transmission body has a relief bore 23 for pressure equalization. The transmission body 22 is supported axially displaceably in the bore 20.

In the interior of the transmission body 22, the guide ring 17 is axially displaceably supported. In the interior of the guide ring 17, the valve shaft 24 is braced against the valve body 11 by means of the disk 18 and the cup spring 19. The guide ring 17 rests by means of a flat seat 25 on the valve body 11. The flat seat 25 can also be embodied by other seat shapes. The spring element 16, which is braced on the transmission body 22, acts on the guide ring 17. The spring element 16 is embodied as a compression spring. The area of the control valve 5 acting on the hydraulic reservoir 15 is $\pi/4\ (d_2^2-d_1^2)$. For the second embodiment, the step-up ratio is thus $(d_3^2-d_2^2)/(d_2^2-d_1^2)$.

In the exemplary embodiment of FIG. 3, the valve actuation unit 6 and the control valve 5 are disposed such that their respective longitudinal axis coincide.

In the relieved state of the valve actuation unit 6, the valve plate 12 is lifted from the valve seat 13 by the stroke $h_2$ and rests on the stop 21. The control valve 5 is opened, and no pressure is built up in the UFI 1. By triggering the valve actuation unit 6, the piezoelectric actuator expands and transmits the expansion motion via the transmission body 22 to the hydraulic reservoir 15. As a result, the pressure of the hydraulic fluid in the hydraulic reservoir 15 is increased and acts on the effective area of the guide ring 17. As a result, the valve body 11 is displaced upward, counter to the force of the compression spring 16, until the valve plate 12 presses against the valve seat 13. The control valve 5 is now closed. In the UFI 1, a pressure is built up, and once the opening pressure of the injection nozzle 3 is exceeded, fuel is injected into the combustion chamber of the engine.

The foregoing relates to preferred exemplary embodiments of the invention, it being understood that other variants and embodiments thereof are possible within the spirit and scope of the invention, the latter being defined by the appended claims.

I claim:

1. A unit fuel injector (1) for delivering fuel to a combustion chamber of direct-injection internal combustion engines, comprising a pump unit (2)and a pump piston (10), that defines a pump work chamber (9) for building up an injection pressure in the pump work chamber (9), said work chamber communicates with an injection nozzle (3) which is operative by an engine cam shaft via an actuator (8), for injecting fuel into the combustion chamber, a control unit (4) that includes a control valve (5) which is disposed in a relief line (26) of the pump chamber (9), the control valve has an outward-opening A-valve member that is actuated by a piezoelectric actuator, and a hydraulic step-up arrangement (14) is disposed between the piezoelectric actuator and the control valve (5), the piezoelectric actuator and the control valve (5) are disposed relative to one another with parallel longitudinal axes extending spaced apart from one another.

2. A unit fuel injector in accordance with claim 1, in which the hydraulic step-up arrangement (14) has a hydraulic closed pressure chamber (15), filled with a hydraulic fluid, with which chamber the piezoelectric actuator and a valve member (11) of the control valve (5) communicate in hydraulically sealed fashion, and the expansion motion of the piezoelectric actuator raises the pressure in the hydraulic closed pressure chamber (15), and the pressure change in the hydraulic closed pressure chamber (15) axially displaces the valve member (11).

3. A unit fuel injector in accordance with claim 2, in which a spring element (16) forces a valve plate (12), extending on an outside around the valve member (11), into an open position away from a valve seat (13) of the control valve (5), and that a pressure rise in the hydraulic closed pressure chamber (15) forces the valve plate (12) onto the valve seat (13) in a closing position, counter to the force of the spring element (16).

* * * * *